US007874707B2

(12) United States Patent
Boehme et al.

(10) Patent No.: US 7,874,707 B2
(45) Date of Patent: Jan. 25, 2011

(54) RECESSED LIGHTING FIXTURE

(75) Inventors: Oliver Boehme, Aachen (DE); Bruno Thoennessen, Simmerath (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 59 days.

(21) Appl. No.: 12/374,323

(22) PCT Filed: Aug. 6, 2007

(86) PCT No.: PCT/IB2007/053080

§ 371 (c)(1),
(2), (4) Date: Jan. 19, 2009

(87) PCT Pub. No.: WO2008/018000

PCT Pub. Date: Feb. 14, 2008

(65) Prior Publication Data

US 2009/0231840 A1 Sep. 17, 2009

(30) Foreign Application Priority Data

Aug. 9, 2006 (EP) ..... 06118670

(51) Int. Cl.
*F21V 15/00* (2006.01)

(52) U.S. Cl. ..... 362/364; 362/260; 362/217.08; 362/217.1; 362/365; 362/335

(58) Field of Classification Search ..... 362/364, 362/365, 363, 329, 335, 260, 217.1, 217.11, 362/217.08
See application file for complete search history.

(56) References Cited

U.S. PATENT DOCUMENTS

| | | | | |
|---|---|---|---|---|
| 3,201,577 | A * | 8/1965 | Brackett | 362/364 |
| 3,634,722 | A * | 1/1972 | Palmer et al. | 313/279 |
| 4,540,911 | A * | 9/1985 | Arai et al. | 313/44 |
| 4,704,664 | A * | 11/1987 | McNair | 362/225 |
| 5,597,233 | A * | 1/1997 | Lau | 362/294 |
| 5,988,836 | A * | 11/1999 | Swarens | 362/364 |
| 2005/0254241 | A1 * | 11/2005 | Harwood | 362/231 |

* cited by examiner

*Primary Examiner*—Sandra L O Shea
*Assistant Examiner*—Danielle Allen
(74) *Attorney, Agent, or Firm*—Mark L. Beloborodov

(57) ABSTRACT

A lighting fixture comprising a reflector 100 and a double-ended elongate lamp 200, the reflector body comprising a casing (110) with a specular cavity having an apex and an aperture rim, wherein the lamp end portions (220, 220') of the double-ended lamp are enclosed in slots (131, 131') located in the casing at opposite sides of the aperture rim and substantially flush with the aperture rim, is extremely flat and slim and therefore useful as a recessed down-light in a shelf, a ceiling, or a wall panel.

8 Claims, 4 Drawing Sheets

RECESSED LIGHTING FIXTURE

This application is a national stage application under 35 U.S.C. §371 of International Application No. PCT/IB2007/053080 filed on Aug. 6, 2007, and published in the English language on Feb. 14, 2008, as International Publication No. WO/2008/018000, which claims priority to European Application No. 06118670.6, filed on Aug. 9, 2006, incorporated herein by reference.

FIELD OF THE INVENTION

This invention relates to a lighting fixture, and more particularly to a lighting fixture adapted to be recess-mounted in a ceiling, wall or shelf. Such fixtures are generally known by the term "down lights" and may be inset into a wall, a shelf, or some other surface to provide illumination in their immediate vicinity.

Lighting fixtures which can be recessed into a wall or a furniture shelf in both new constructions and retrofit situations have become useful in a variety of lighting situations due to the unobtrusive, aesthetically pleasing nature of the fixtures themselves and to the effective illumination provided by the fixtures.

BACKGROUND OF THE INVENTION

Conventional recessed lighting fixtures are intended for mounting in a support structure, particularly between joists or a grid work supporting a suspended ceiling or canopy installation, which conceals the lamp as well as internal components such as sockets, wiring, junction boxes, ballast, temperature switches, etc behind the plane of the mounting surface.

With the development of lamps operating on the so-called halogen regenerative cycle, advances have been made in reducing the size of the lamp and the reflector associated with the lamp. This has made it possible to design lighting fixtures that can be mounted without any separate support structure.

DE 41 05 056 A1 discloses a shallow low-voltage halogen radiator assembly which can be mounted in the blind hole of a shelf without the use of a support structure. Although the lamp assembly according to DE 41 05 056 A1 is much flatter than previous lamp assemblies, it still extends over an appreciable distance into the width of a shelf or a panel and might weaken the rigidity of the furniture or ceiling.

It is therefore an object of the invention to provide a lighting fixture of the kind referred to, which can be recessed into a shelf, ceiling or wall of minimum height, which can be economically manufactured, and which can be easily and accurately installed and conveniently replaced when burnt out.

SUMMARY OF THE INVENTION

To this end the invention provides a lighting fixture comprising a reflector and a double-ended elongate lamp, the reflector body comprising a casing with a specular cavity having an apex and an aperture rim, wherein the lamp end portions of the double-ended lamp are enclosed in slots located in the casing at opposite sides of the aperture rim and substantially flush with the aperture rim.

The invention provides a novel and improved lighting fixture which is particularly adapted, among other uses, for illuminating places where it is desirable that the unit be permanently inset into the surface, preferably of a shelf or a wall, in a position in which no part of the fixture projects materially beyond the face of the shelf or wall.

The present lighting fixture is simple in construction and lends itself to economical manufacture and simplicity in installation in a wall or shelf.

Furthermore, the invention avoids any opening at the reflector apex for a leadthrough of the electrical connections.

Thus, the invention avoids any need for a lamp mounting assembly, such as crimped legs and/or a socket, at the reflector apex, because mounting and contacting of the lamp take place at the reflector rim. Thus, the invention results in an enlargement of the reflector's internal surfaces and thus in a higher light output of the lighting fixture.

In a preferred embodiment, the lighting fixture comprises a reflector and a double-ended elongate lamp, the reflector body comprising a truncated casing with a truncated specular cavity having an apex and an aperture rim, wherein the lamp end portions of the double-ended lamp are enclosed in slots located in the casing at opposite sides of the aperture rim and substantially flush with the aperture rim.

The truncated shape of the reflector according to the invention achieves a very high degree of flatness.

The truncated casing enables the lighting unit to be set in a vertical wall or surface of minimum height with a minimum weakening of the wall and therefore enables the lighting fixture to be set in the blind hole in a furniture shelf with minimal weakening of the structure.

If the apex to rim distance of the cavity is chosen to be less than 2d, wherein d is the diameter of the elongate lamp, the lighting fixture can be mounted in a blind hole recess of a wall or shelf with a minimal weakening of the wall or shelf used as support.

A lighting fixture according to the invention in which the length of the longitudinal axis of the double-ended lamp is greater than the inner diameter of the aperture rim and less than the outer diameter of the reflector casing has a relatively small axial dimension and will not to reduce the strength of a furniture shelf or a wall panel.

Preferably, in a lighting fixture according to the invention, the truncated specular cavity comprises cylindrical, ellipsoidal, or paraboloidal side wall segments and a barrel-shaped rear wall segment, and the truncated dome-shaped casing comprises cylindrical side walls and a barrel-shaped cap.

Typically, the aperture rim is covered with a frame piece bearing a transparent plate.

The double-ended elongate lamp may be selected from the group of incandescent lamps, halogen lamps, high- and low-pressure discharge lamps, but in accordance with the preferred practice of the present invention, the lighting fixture includes a low-voltage or mains-voltage halogen lamp, thus allowing a compact and flat construction of low-voltage and mains-voltage lamp fixtures.

DETAILED DESCRIPTION OF THE INVENTION

The present invention relates to a lighting fixture comprised of two basic sub-assemblies: a reflector body and a double-ended lamp held in the reflector body.

FIG. 1 is a front view of a lamp/reflector unit in accordance with a first embodiment of the invention. An elongate, substantially tubular double-ended lamp 200 with a longitudinal axis of symmetry is axially arranged in a reflector body 100.

As can be seen in FIGS. 2 and 3, the reflector body 100 comprises a) a shallow reflector casing 110 with external surface 111, b) an open reflector cavity 120 with internal specular surface 121, and c) a frame piece 140 covering the aperture rim of the reflector.

For reference, a rectangular three-dimensional Cartesian coordinate system may be defined in the Figures, wherein a z axis is defined as being the optical axis of the reflector cavity, and the rim aperture defines an xy-plane, the x axis being arranged in parallel to the longitudinal lamp axis x* and the y axis being perpendicular thereto.

In the following the terms "rear", "side", "front" and "down" are used only to facilitate a description of the claimed invention and do not limit the orientation of the lighting fixture, i.e. in a ceiling, a vertical wall, a shelf, or a floor.

FIG. 4 is a front view of a lamp/reflector unit in accordance with a preferred embodiment of the invention comprising a truncated reflector.

As can be seen in FIGS. 5 and 6, the truncated reflector body 100 comprises a) a shallow truncated reflector casing 110 with external surfaces 111, 112, b) an open truncated reflector cavity 120 with internal specular surfaces 121,122, and c) a frame piece 140 covering the aperture rim of the reflector.

As is generally known, the internal specular surfaces of the truncated reflector cavity are designed such that all rays of light incident thereon will be cast in a generally downward direction.

In particular, the internal specular surfaces 121, 122 of the truncated reflector cavity include two 90° axially offset wall segments: a first wall segment 121, which defines a reflector side wall segment, and a second segment 122, which defines an oblate reflector rear wall segment.

The optical contour of the first wall segment 121, the side wall segment, is formed as a surface of revolution centered on an upright axis z and defined by a geometric curve rotated about said upright axis z in order to produce an annular ring segment with a focal aperture.

Preferably, the reflector sidewall segment 121 presents a segment of a paraboloid, an ellipsoid, a cone, or a cylinder.

The side wall segment is adjoined by the second wall segment, i.e. the rear wall segment 122. The optical contour of the surface of the rear wall segment is formed as a surface of revolution centered on the longitudinal axis x* of the elongate, double-ended lamp. Typically, the rear wall segment forms part of a cylinder with a diameter equal to or greater than the length of the double-ended lamp, thus forming a shallow vault for the reflector cavity.

Preferably, parts of the lower side edges of the rear wall segment 122 touch the rim plane of the cavity at opposite sites perpendicularly to the lamp axis.

These respective wall segments 121 and 122 have distinctly different functions.

The side wall segment 121 of the internal specular surfaces serves to provide an aesthetically pleasing appearance from typical viewing angles while also spreading light smoothly into a broad beam.

The rear wall segment 122 of the internal specular surfaces also serve as a heat shield that reflects excessive heat back to the lamp filling.

The truncated shape of the reflector of the invention achieves a very high degree of flatness.

The reflector outer casing 110 has a shallow truncated outer contour in the shape of a low dome which generally follows the inner contour of the reflector cavity.

Hence the outer surface of the reflector body is configured with a similar, though not necessarily the same, curvature as the specular cavity, so that the cavity lies flush therewith.

The outer contour of the truncated reflector casing 100 as a result also comprises a first and a second side wall segment 111 and a rear wall segment 112 truncating the side wall segment 111.

In one preferred embodiment shown in FIGS. 5 and 6, the reflector outer casing includes a rear wall segment that truncates the side wall segment by means of a barrel-shaped cap in a 90° offset direction.

In a preferred embodiment, the casing has a cylindrically curved side wall portion which merges into the cylindrically shaped rear wall portion. However, the reflector casing may have various shapes, such as substantially square or rectangular.

The reflector body comprises a lower annular rim that defines a bottom aperture of the reflector cavity.

The annular rim defines a reference plane xy located in a predetermined, fixed relationship to the optical axis z. In the preferred embodiment, the plane within which the annular rim lies is perpendicular to the optical axis z.

Preferably, the aperture rim is substantially circular in shape to match the shape of the internal specular surfaces. Alternatively, however, the central opening may be of any polygonal or curved shape.

The lower rim of the reflector body is concealed by a frame piece 140. The frame piece is also provided for concealing the portion of the wall shelf or ceiling that extends behind the frame.

Preferably, the frame piece also has a cylindrical shape with a circular cross-section in the region where it has its seat in a shelf or a panel. The lamp can thus be readily adjusted with respect to its height and rotary position.

To improve the optical performance of the light directed downwards from the fixture, the frame piece may further include a transparent cover plate 142 covering the aperture.

As shown most clearly in FIG. 9, the frame piece 140 comprises a stepped inner surface, including a ledge 141 against which the transparent cover plate 142 can be placed. The ledge 141 ensures that the cover is tightly pressed against the frame piece and is adapted to engage the cover plate so as to provide a watertight connection between the cover plate and the faceplate Typically, said cover plate is secured in position by means of glue or other suitable means The cover may have either a clear or a frosted inner surface, so that the transparent cover plate is light-scattering. The possibility of directly viewing components of high luminance is counteracted thereby.

In a favorable embodiment of the invention, the casing, specular cavity, and frame piece are constructed as an integral one-piece component which may be formed of any suitable material, such as a machined or molded metal, e. g. aluminum, which may be polished or metallized, or metallized plastic, for example a vacuum-metallized injection-molded polycarbonate polymer with a UV-resistant and scratch-resistant lacquer. A typical present-day reflector is made of a molded thermoplastic or thermoset material such as phenolic resin.

The internal surfaces are specular or semispecular. A typical suitable material for this purpose is aluminum.

This construction is best suited for use with reflector elements made from insulating materials. Nevertheless, the construction can be readily adapted for use with metal reflector elements.

The lighting fixture also includes a lamp receptacle that holds a double-ended lamp at the front end of the reflector cavity.

The lighting fixture according to the invention is usually designed for operation at mains voltage, which is to be understood as being a range from approximately 60 V to 250 V, and with various power ratings. It is preferably assembled with a mains-voltage halogen incandescent lamp or with some other particularly small-format incandescent or fluorescent lamp.

The invention is equally applicable to lighting fixtures comprising low-voltage double-ended halogen lamps designed for operation at low voltages (below 60 V).

Alternatively, the light source may be a high-pressure gas discharge lamp, for example a high-pressure sodium discharge lamp with tungsten electrodes in a discharge vessel of monocrystalline or polycrystalline aluminum oxide, or a high-pressure mercury discharge lamp, possibly with a metal halide, or lamp with a high-pressure xenon filling and tungsten electrodes in a discharge vessel made of quartz glass or aluminum oxide.

In general, double-ended lamps comprise an elongate vitreous envelope that encloses as a light source either a filament or electrodes and that is hermetically sealed at both ends.

The elongate vitreous envelope defines a central longitudinal axis of rotation x*.

In a preferred embodiment, the elongate envelope is of cylindrical, tubular, or ellipsoidal shape.

The double-ended lamp 200 has a first (220) and a second (220') end portion which are arranged opposite each other and each provided with a seal, through which seals respective current conductors (not shown) extend from the end portions of said lamp to the exterior.

In a preferred embodiment, the double-ended lamp is a halogen incandescent lamp with a filament, which lamp is generally made of a quartz tube enclosing a tungsten filament within a filament chamber and is hermetically sealed at both ends by means of a flat pinch or shrink seal over a molybdenum foil seal assembly. One or more halogens are sealed within the filament chamber, whose surface may or may not contain a coating or filter which transmits and/or reflects selective portions of light radiation emitted by the filament. The end portions of such lamps generally include extremely thin flattened ribbon or foil portions which are embedded in and sealed through the wall of the fused silica envelope in that the silica is made to collapse and is firmly sealed around the foil as a substantially flat pinch seal.

Said double-ended lamp is mounted such that its longitudinal axis is disposed at right angles to the longitudinal optical axis of said reflector and the envelope is substantially flush with the aperture rim.

To this end, the side wall portion of the reflector rim is interrupted so as to provide a pair of mutually opposed slots 131, 131* into which the necks of the double-ended lamp are fitted.

As can best be seen in FIG. 8, the slots 131, 131* are adapted to be aligned with the rim of the reflector aperture.

The slots are provided with bushings that lie flush with the aperture of the reflector to encompass the lamp support and electrical feed-through.

The lamp end portions are secured in the bushings by any suitable, standard, well-known method of securing a lamp to a reflector body.

According to a preferred embodiment of the invention, the length of the longitudinal axis of the double-ended lamp is greater than the inner diameter of the aperture rim and smaller than the outer diameter of the reflector casing. The lamps end portions thus extend into the reflector body.

The bushings are at the same time carriers of lead wires which are connected to the filament or electrodes of the lamp and which are designed for being connected to an external electrical supply source If desired, protrusions 150 may project outward from the exterior surface of the reflector, and the lead wires may be secured in the protrusions. In a metal reflector element, the protrusions conveniently serve to contain insulating seals between the lamp contact elements? and the reflector element.

In one embodiment, the lamp end portions and associated lead wires are fixed into the bushings with cement around the end portions of the lamp necks. Materials known in the art are used as cement, for example steatite, aluminum oxide, aluminum nitride, silicone-based cement, or the like. Particularly preferred for use herein is a material commercially available as L3 Steatite which comprises SiO2—MgO—BaO.

Alternatively, the lamp support is a hollow clasp member which embraces and grips the seal end of the lamp. The clasp member has mutually opposed recesses for mating with correspondingly shaped ribs on the seal end of the lamp and is so designed that said seal snaps into engagement therewith.

Whilst the bushings are designed primarily for permanently mounting the lamp 200, they may yet be used where they are detachable to allow replacement thereof.

In order to supply electrical current to the lamp, pin connectors 160 are secured to the lead wires in one embodiment of the invention. The lead wires extend outward from the reflector body and are adapted to be engaged in pin connectors. The pin connectors may be carried in an appropriately configured socket. The pin connectors may be fixed with respect to the reflector by means of cement. FIG. 7 shows a lighting fixture in which the pin connectors 160 are fixed to the reflector body.

Electrical contacts may alternatively be provided in various configurations, preferably aligned with the slots and positioned at approximately that level up to which the slots extend into the protrusions. In the embodiment shown in FIG. 3, spring contacts 230 are used for power supply.

Consequently, the lamp unit has a relatively small axial dimension, and pin connectors are not required.

For assembly of the lighting fixture, the lamp 100 is positioned within the cavity of the reflector and held in that position as illustrated in FIG. 1. The lead wires are passed through the slots 131, 131* and are extended laterally outwards through the protrusions 150.

Cement is placed in the slots until the slots are completely filled. A transparent cover plate is glued into the frame piece. Pin connectors are preferably fastened to the lead wires. After that the lighting fixture is ready for use.

Thus the completed lighting fixture contains lamp 200 mounted flush with the bottom portion of reflector body 100 by means bushings encompassing lamp end portions as well as associated lead wires which project through holes at the rim portion reflector.

Since the geometry of the lighting fixture is primarily defined by the size and shape of the mechanical structure necessary for holding the double-ended lamp in place and for permitting its adjustment, it is evident that the reflector body plays no significant part in terms of height and width of the fixture.

The axial dimension of the lamp may vary within wide limits and may lie, for example, between 10 and 60 mm. The diameter of the lamp is much smaller, e.g. 5 to 10 mm.

Typical dimensions for a mains-voltage lighting fixture are a length of the elongate lamp including its end portions of 50 mm and an outer diameter of the frame piece of 65 mm. The diameter of the lamp is typically 10 mm, the overall height of the fixture is 20 mm.

Typical dimensions for a low-voltage lighting fixture are a lamp with an overall length of 30 mm and a diameter of 5 mm. The dimensions of the lighting fixture then are 50 mm length, 8 mm apex to rim distance, and 12 mm overall height.

The manner of mounting the lighting fixture in a conventional recessed blind hole or a grid is well known to those skilled in the art and need not be described in detail.

Figure 1:
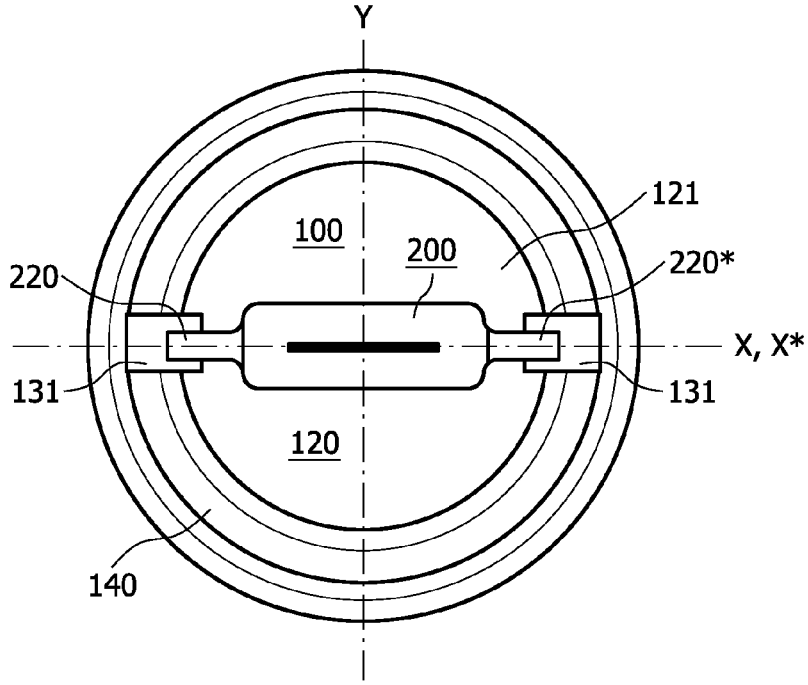
FIG. 1 is a front view of a lighting fixture in accordance with the invention.
Figure 2:
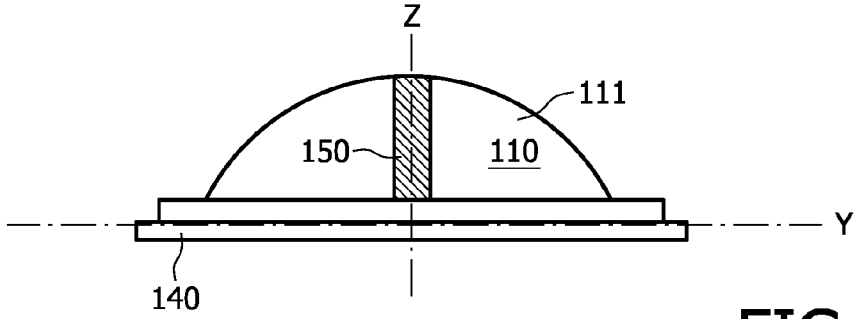
FIG. 2 is a schematic side view of a lighting fixture in accordance with the invention in parallel to the lamp axis.
Figure 3:
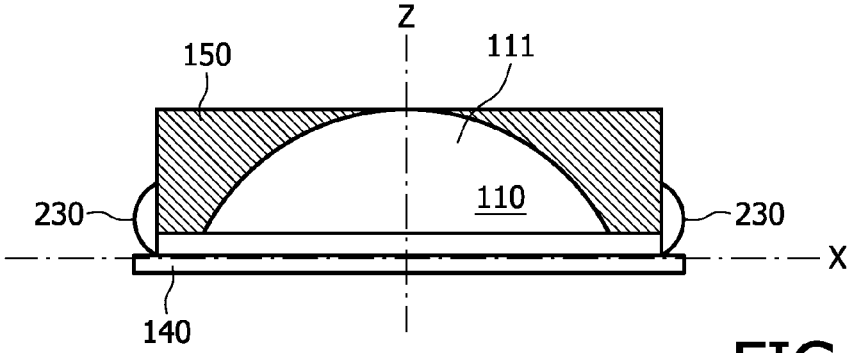
FIG. 3 is a schematic side view of a lighting fixture in accordance with the invention perpendicular to the lamp axis.
Figure 4:
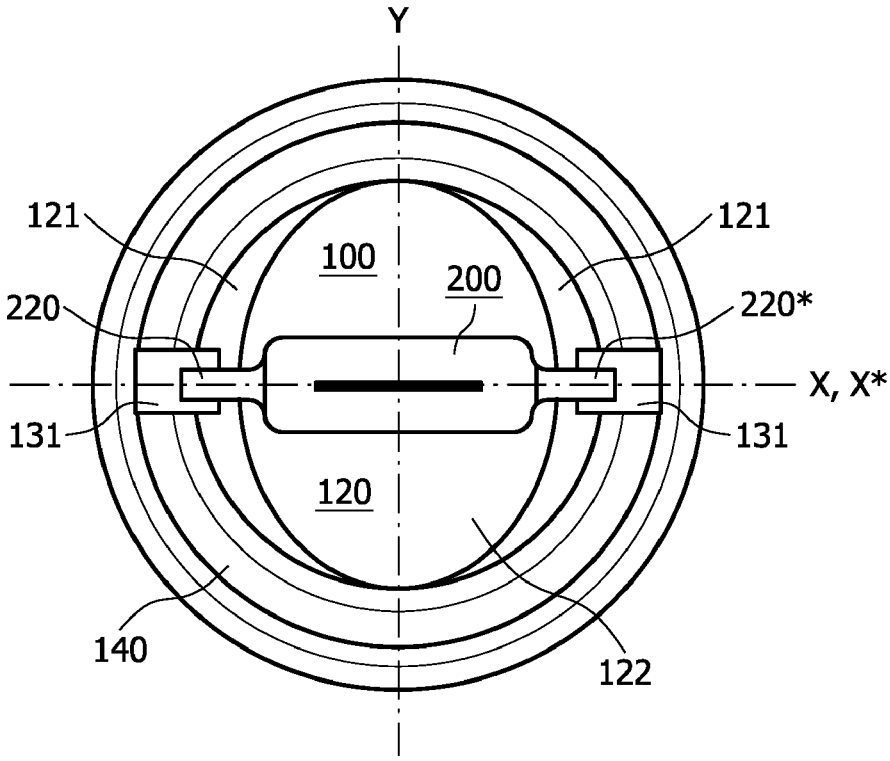
FIG. 4 is a front view of a lighting fixture comprising a truncated reflector.
Figure 5:
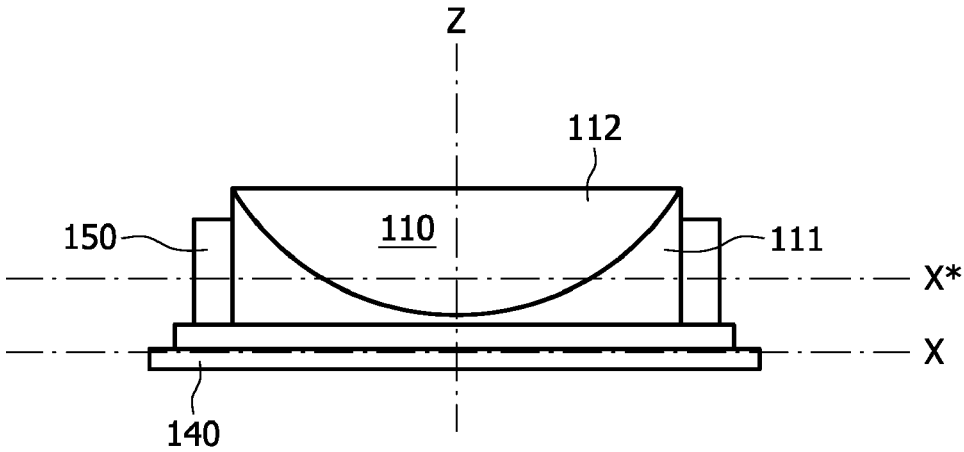
FIG. 5 is a schematic side view of a lighting fixture according to FIG. 4 in parallel to the lamp axis.
Figure 6:
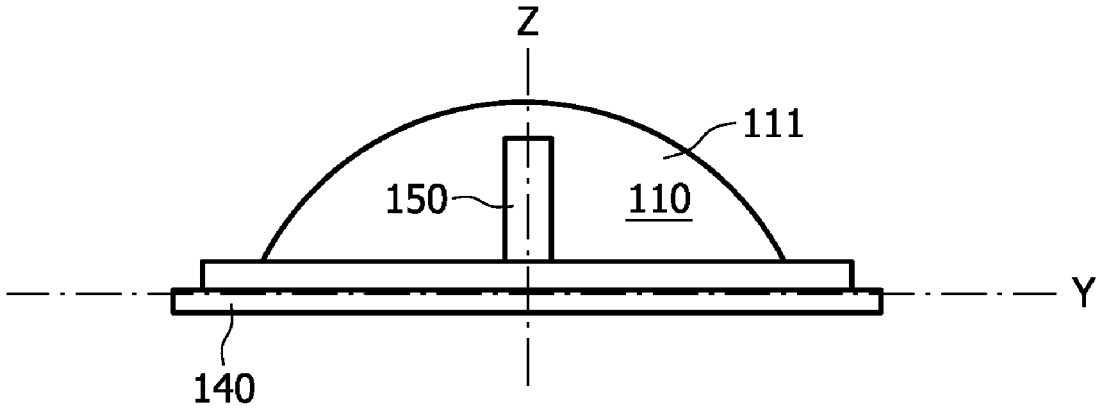
FIG. 6 is a schematic side view of a lighting fixture in accordance with FIG. 4 perpendicular to the lamp axis.
Figure 7:
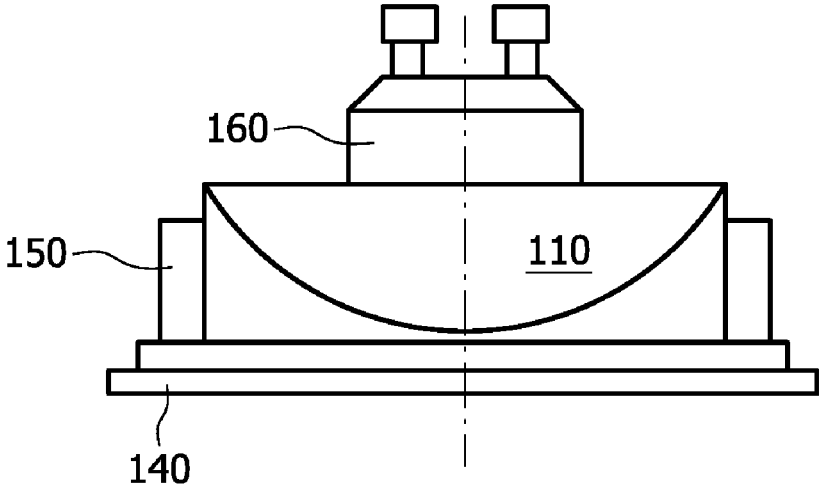
FIG. 7 is a schematic side view of a lighting fixture in accordance with the invention in parallel to the lamp axis comprising pin connectors.
Figure 8:
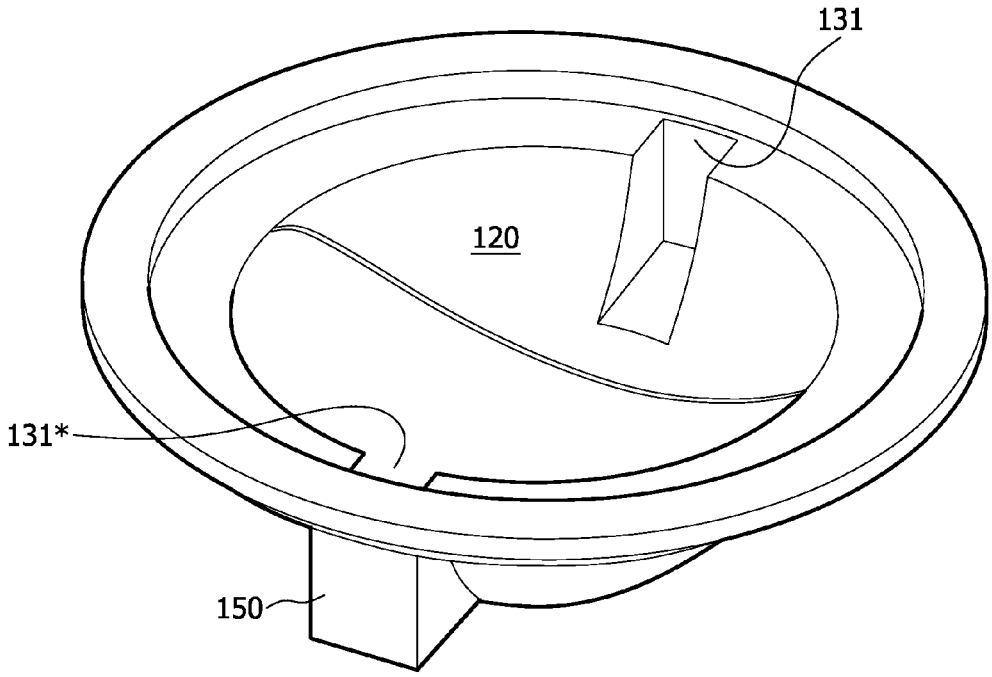
FIG. 8. is a view into the cavity of the reflector body.
Figure 9:
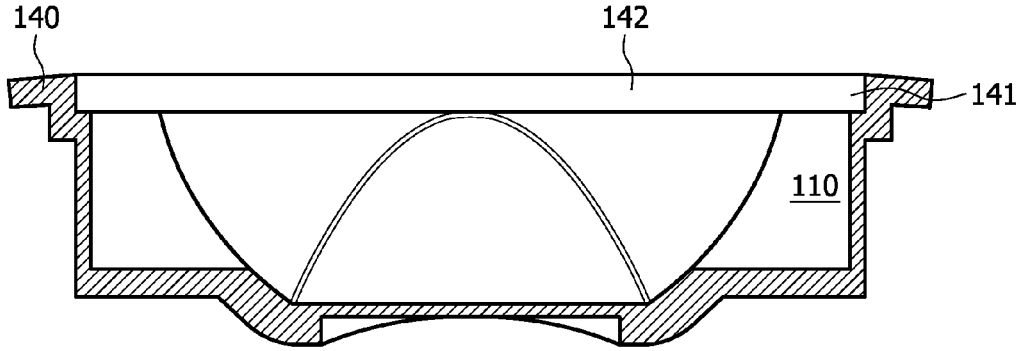
FIG. 9 is a cross-section through the reflector body.

The invention claimed is:

1. A lighting fixture comprising a reflector and a double-ended elongate lamp, the reflector body comprising a truncated casing defining a truncated specular cavity having an apex and an aperture rim, wherein the end portions of the double-ended lamp are enclosed in slots located in the casing at mutually opposed sides of the aperture rim and substantially flush with the aperture rim, wherein internal specular surfaces of the truncated specular cavity include a first wall segment defining a reflector side wall segment, and a second segment defining an oblate reflector rear wall segment, the first wall segment and the second wall segment being 90° axially offset, wherein the first segment is formed as a surface of revolution centered on an optical axis of the truncated specular cavity, and wherein the second segment is formed as a surface of revolution centered on a longitudinal axis of the double-ended lamp.

2. A lighting fixture according to claim 1, wherein the distance between the apex and the aperture rim of the reflector cavity is less than 2d, wherein d is the diameter of the lamp.

3. A lighting fixture according to claim 1, wherein the length of the double-ended lamp along its longitudinal axis is greater than the inner diameter of the aperture rim and less than the outer diameter of the reflector casing.

4. A lighting fixture according to claim 1, wherein the truncated specular cavity comprises at least one cylindrical, ellipsoidal, or paraboloidal side wall segment and a barrel-shaped rear wall segment.

5. A lighting fixture according to claim 1, wherein the truncated casing is dome-shaped and comprises cylindrical side walls and a barrel-shaped cap.

6. A lighting fixture according to claim 1, further comprising a frame piece covering the aperture rim and supporting a transparent plate.

7. A lighting fixture according to claim 1, wherein the double-ended elongate lamp is selected from the group consisting of: incandescent lamps, halogen lamps, and high- and low-pressure discharge lamps.

8. A lighting fixture according to claim 1, wherein the double-ended elongate lamp is a mains-voltage or low-voltage halogen lamp.

* * * * *